US008978570B2

(12) United States Patent
Mauck et al.

(10) Patent No.: US 8,978,570 B2
(45) Date of Patent: Mar. 17, 2015

(54) LIFTING FLOOR FOR BODIES OF WATER

(71) Applicant: Oceaneering International, Inc., Orlando, FL (US)

(72) Inventors: David C. Mauck, Orlando, FL (US); William Bryan, Annapolis, MD (US); Ronald H. Garber, Orlando, FL (US); Clifford A. Jennings, Highland, MD (US); Nicholas K. Miller, Sykesville, MD (US); John Linn, Winter Garden, FL (US)

(73) Assignee: Oceaneering International, Inc., Houston, TX (US)

( * ) Notice: Subject to any disclaimer, the term of this patent is extended or adjusted under 35 U.S.C. 154(b) by 35 days.

(21) Appl. No.: 13/733,429

(22) Filed: Jan. 3, 2013

(65) Prior Publication Data

US 2013/0174770 A1 Jul. 11, 2013

Related U.S. Application Data

(60) Provisional application No. 61/583,453, filed on Jan. 5, 2012.

(51) Int. Cl.

| | |
|---|---|
| ***B63B 35/44*** | (2006.01) |
| ***B63B 3/08*** | (2006.01) |
| ***B63C 1/04*** | (2006.01) |
| ***E04H 4/06*** | (2006.01) |
| *B63B 5/24* | (2006.01) |

(52) U.S. Cl.

CPC . *B63B 35/44* (2013.01); *B63B 3/08* (2013.01); *B63C 1/04* (2013.01); *E04H 4/065* (2013.01); *B63B 5/24* (2013.01); *B63B 2207/02* (2013.01)

USPC ..... 114/267; 114/266

(58) Field of Classification Search

USPC ..... 114/263, 264, 267, 266

See application file for complete search history.

(56) References Cited

U.S. PATENT DOCUMENTS

| | | | |
|---|---|---|---|
| 2,928,103 | A | 3/1960 | Turner |
| 2,970,320 | A | 2/1961 | Karp |
| 3,590,399 | A | 7/1971 | Madden |
| 3,668,711 | A | 6/1972 | Liermann et al. |
| 3,670,343 | A | 6/1972 | Gansloser |
| 3,734,113 | A | 5/1973 | Madden |
| 3,760,432 | A | 9/1973 | Glorisi |

(Continued)

FOREIGN PATENT DOCUMENTS

| | | |
|---|---|---|
| JP | 4085464 | 3/1992 |
| JP | 2007016581 A | 1/2007 |

OTHER PUBLICATIONS

The International Search Report and the Written Opinion of the International Searching Authority, Mailed on Mar. 16, 2013, in International Application No. PCT/US2013/020333.

*Primary Examiner* — Lars A Olson

(74) *Attorney, Agent, or Firm* — Gary R Maze

(57) ABSTRACT

A lifting platform for use in a body of water has (a) a plurality of float modules, each float module having a buoyancy compartment, and each float module being attached to adjacent float modules by means of flexible joints; (b) at least one container disposed in each float module for retaining a buoyancy fluid; and (c) a discharge apparatus for discharging buoyancy fluid to the buoyancy compartments of the float modules, so as to fill each buoyancy compartment with buoyancy fluid, thereby causing the plurality of modules to float to a position at or near the surface of the body of water.

34 Claims, 12 Drawing Sheets

(56) References Cited

U.S. PATENT DOCUMENTS

| | | | | |
|---|---|---|---|---|
| 3,942,459 | A | 3/1976 | Sato | |
| 3,955,797 | A | 5/1976 | Richards | |
| 4,106,134 | A | 8/1978 | Schiron et al. | |
| 4,229,843 | A | 10/1980 | Belanger | |
| 4,283,801 | A | 8/1981 | Smith | |
| 4,364,131 | A | 12/1982 | Clerk | |
| 4,574,404 | A | 3/1986 | Stark, Sr. | |
| 4,604,962 | A | 8/1986 | Guibault | |
| 4,831,672 | A | 5/1989 | Niimura | |
| 4,937,896 | A | 7/1990 | Niimura | |
| 5,025,512 | A | 6/1991 | Niimura | |
| 5,038,894 | A | 8/1991 | Watanabe | |
| 5,271,483 | A | 12/1993 | Hong | |
| 5,347,773 | A | 9/1994 | Thil | |
| 5,522,671 | A | 6/1996 | Keesling | |
| 5,657,589 | A | 8/1997 | De Bood | |
| 5,678,253 | A | 10/1997 | Baker | |
| 5,692,857 | A | 12/1997 | Ness | |
| 5,832,547 | A | 11/1998 | Burroughs | |
| 5,931,113 | A | 8/1999 | Eva et al. | |
| 6,105,180 | A | 8/2000 | Kramer | |
| 6,253,390 | B1 | 7/2001 | Laks | |
| 6,574,804 | B1 | 6/2003 | Boujon | |
| 6,640,504 | B2 | 11/2003 | Pearlson et al. | |
| 7,213,531 | B2 * | 5/2007 | Ahern | 114/263 |
| 7,249,386 | B2 | 7/2007 | Terzo | |
| 7,426,898 | B1 * | 9/2008 | Ahern | 114/263 |
| 2007/0256228 | A1 | 11/2007 | Nexon | |
| 2009/0126096 | A1 | 5/2009 | Bocos | |
| 2009/0235446 | A1 | 9/2009 | Juracek | |
| 2010/0122406 | A1 | 5/2010 | Gschwind | |
| 2010/0186159 | A1 | 7/2010 | Dalickas | |

* cited by examiner

LIFTING FLOOR FOR BODIES OF WATER

RELATED APPLICATION

This application claims priority from U.S. Provisional Application Ser. No. 61/583,453, filed on Jan. 5, 2012, entitled EMERGENCY LIFTING FLOOR FOR LARGE POOL OR POND, the entirety of which is incorporated herein by reference.

FIELD OF THE INVENTION

The invention relates generally to lifting floors for open bodies of water and enclosed pools. The invention is especially directed to emergency lifting platforms capable of raising a substantial load to the surface of a large pool in a very short period of time.

BACKGROUND OF THE INVENTION

Lifting floors for large bodies of water are known for lifting objects, such as boats from marina harbors and lifting humans in small enclosed pools. U.S. Pat. No. 5,692,857 also discloses a lifting platform for raising a large mammal to the surface of an enclosed pool.

Nothing in the prior art, however, suggests or discloses a lifting platform capable of lifting a very large load to the surface of a body of water in a very short period of time. There is a need for such a lifting platform to address, for example, emergency situations which arise with large aquatic mammals in large enclosed pools.

SUMMARY OF THE INVENTION

The invention satisfies this need. The invention is an emergency lifting floor 10 for raising the entire floor in an open body of water or enclosed pool. The invention can be used for many purposes, but it is especially directed to lifting one or more large aquatic animals, such as killer whales, to above the surface of an aquatic amusement park pool under emergency conditions.

In a broad sense, the lifting floor comprises (a) a plurality of float modules, each float module having a hull with downwardly extending side walls, a top wall, a bottom and a buoyancy compartment, each float module being attached to adjacent float modules by means of flexible joints; (b) at least one container disposed in each float module for retaining a buoyancy fluid having a density less than that of water; and (c) a discharge apparatus for discharging buoyancy fluid from each container, so as to fill the buoyancy compartment of some or all of the float modules with buoyancy fluid, thereby causing the plurality of modules to float to a position at or near the surface of the body of water

DRAWINGS

These and other features, aspects and advantages of the present invention will become better understood with reference to the following description, appended claims and accompanying drawings where:

DETAILED DESCRIPTION OF THE INVENTION

Figure 1:
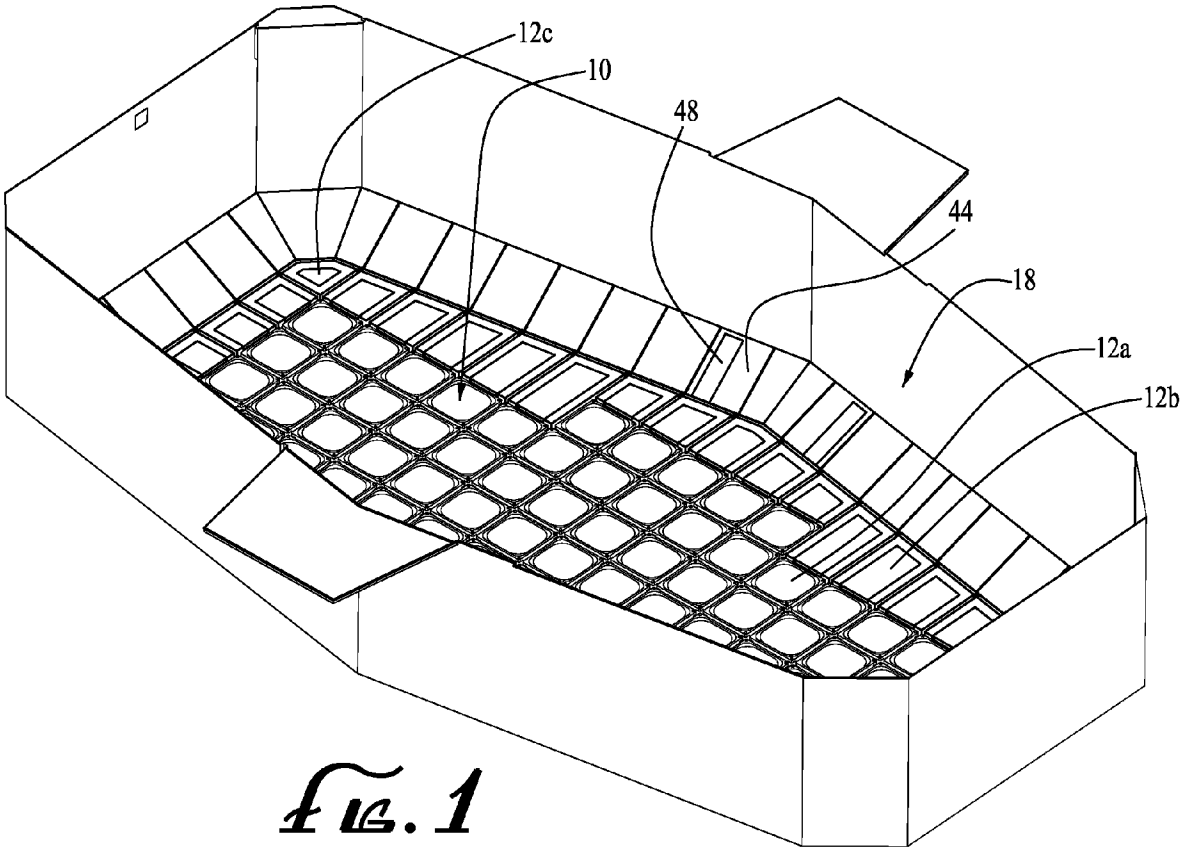
FIG. 1 is a perspective view of a lifting floor having features of the invention, shown near the bottom of an enclosed pool.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a lifting floor 10 for use in a body of water. The body of water is typically a large confined pool, but it can also be an open body of water, such as a marina or other boat harbor. The lifting floor 10 comprises a plurality of float modules 12, at least one container 14 disposed in each float module and a discharge apparatus 16.

The lifting floor 10 is designed to reside on the bottom of a body of water, and, when required, use buoyancy assemblies 32 to blow air or other low density fluid into buoyancy compartments 28 within each float module 12—thereby causing the lifting platform 10 to rise to at or near the surface in a very short period of time, if necessary. By "near the surface," it is meant within about 30 inches of the surface, typically within about 18 inches of the surface.

The time for the emergency lifting floor 10 to deploy to the raised position in an emergency situation is typically 30 to 60 seconds, depending on water depth.

Figure 2:
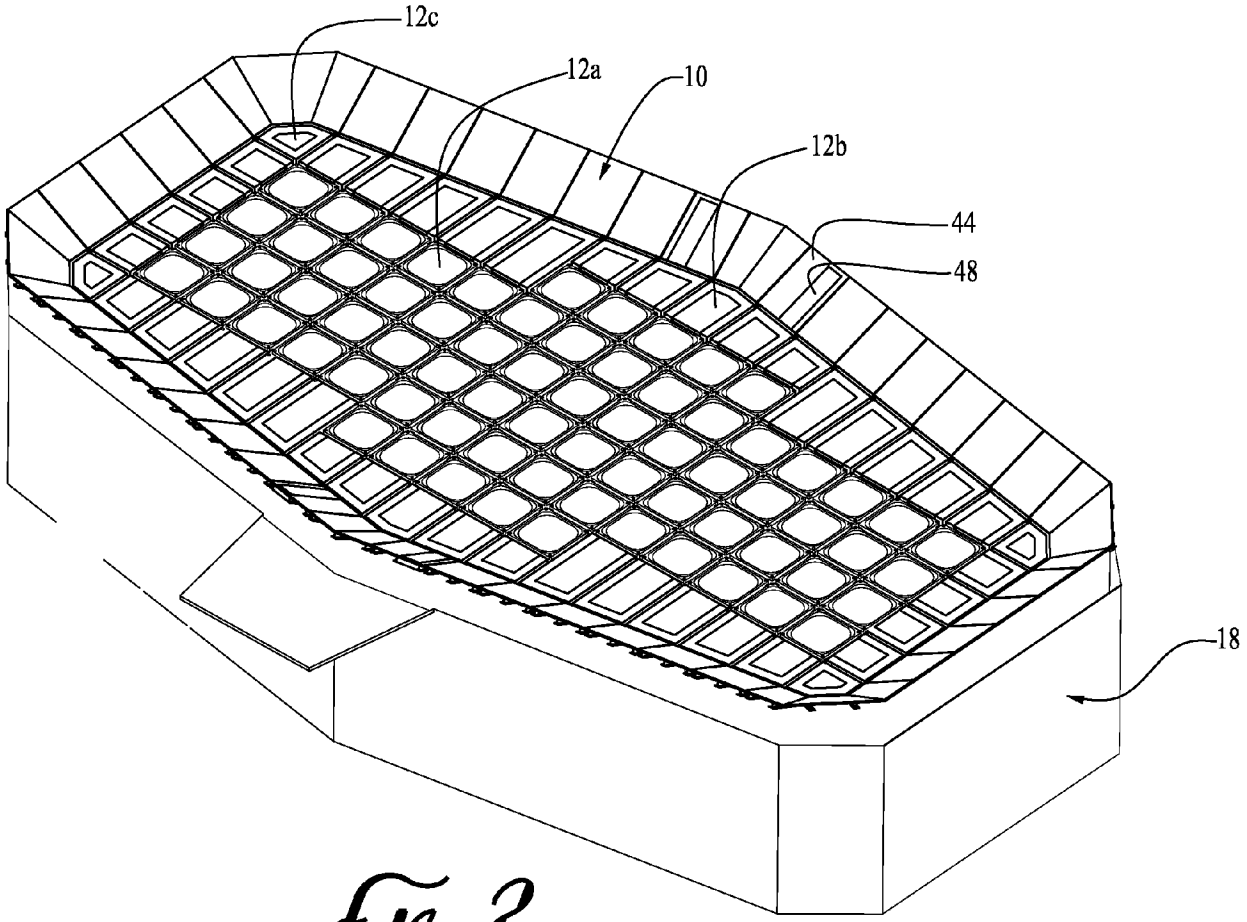
FIG. 2 is a perspective view of the lifting floor illustrated in FIG. 1, shown near the top of the enclosed pool.
Figure 3:
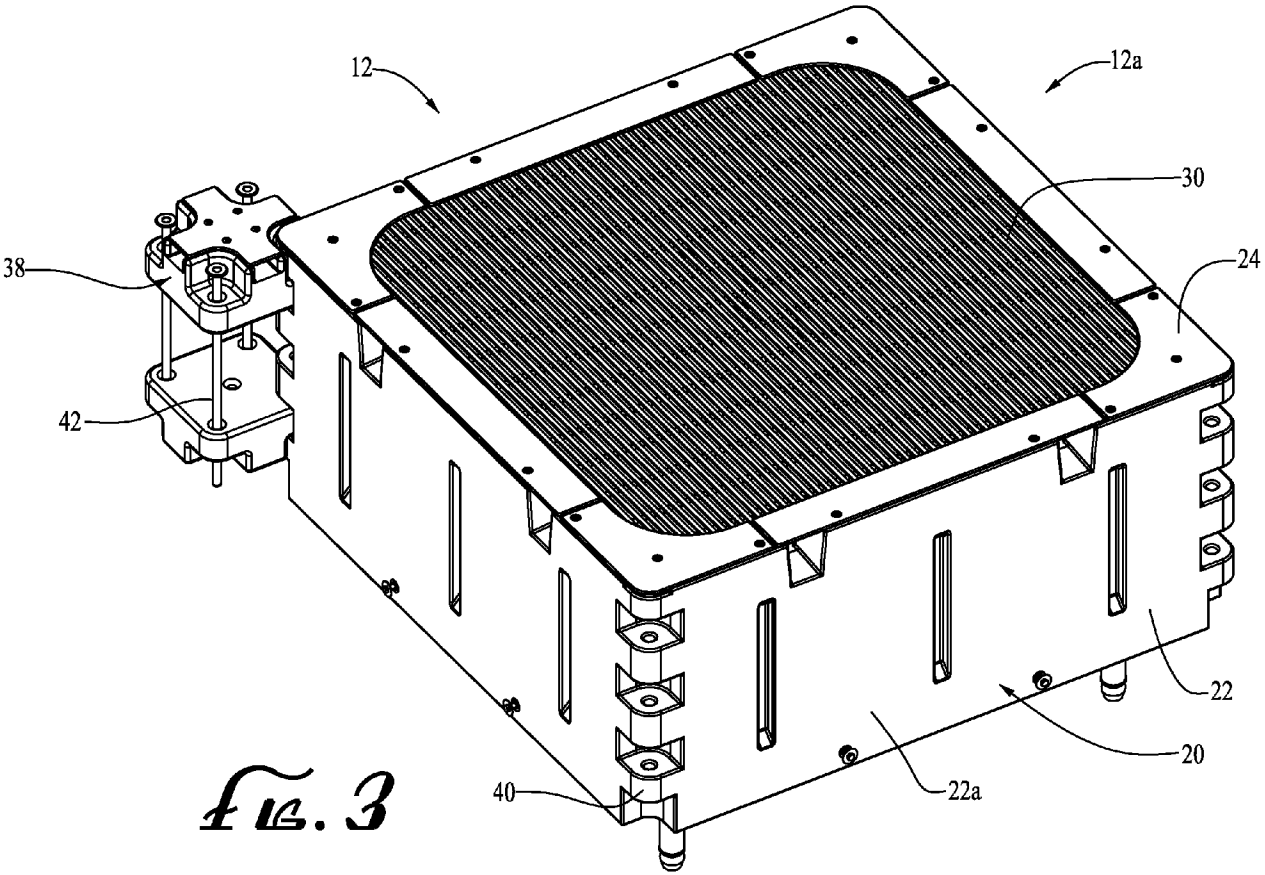
FIG. 3 is a perspective view of a module used in the lifting floor illustrated in FIG. 1.
Figure 4:
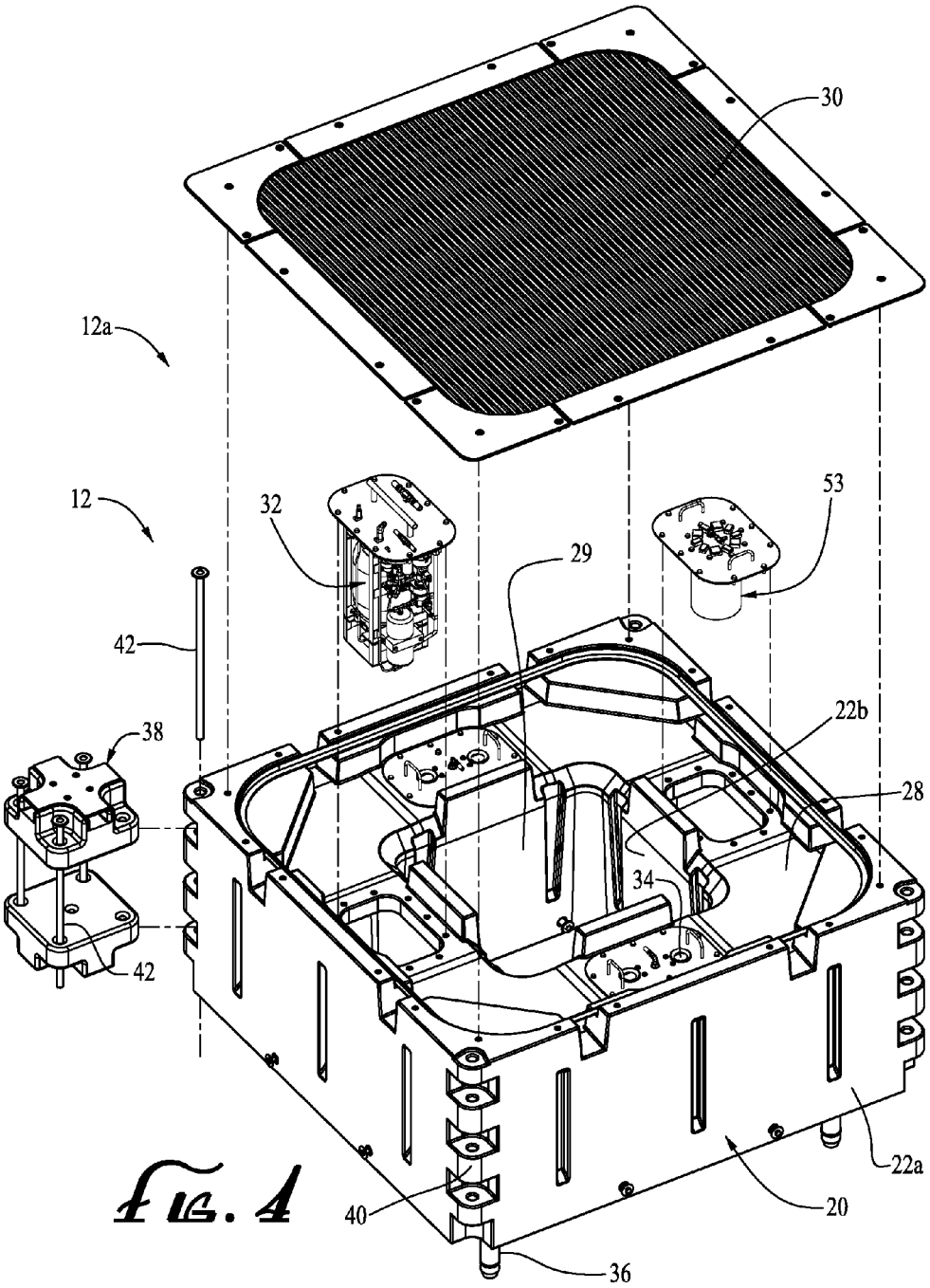
FIG. 4 is an exploded view of the module illustrated in FIG. 3.
Figure 5:
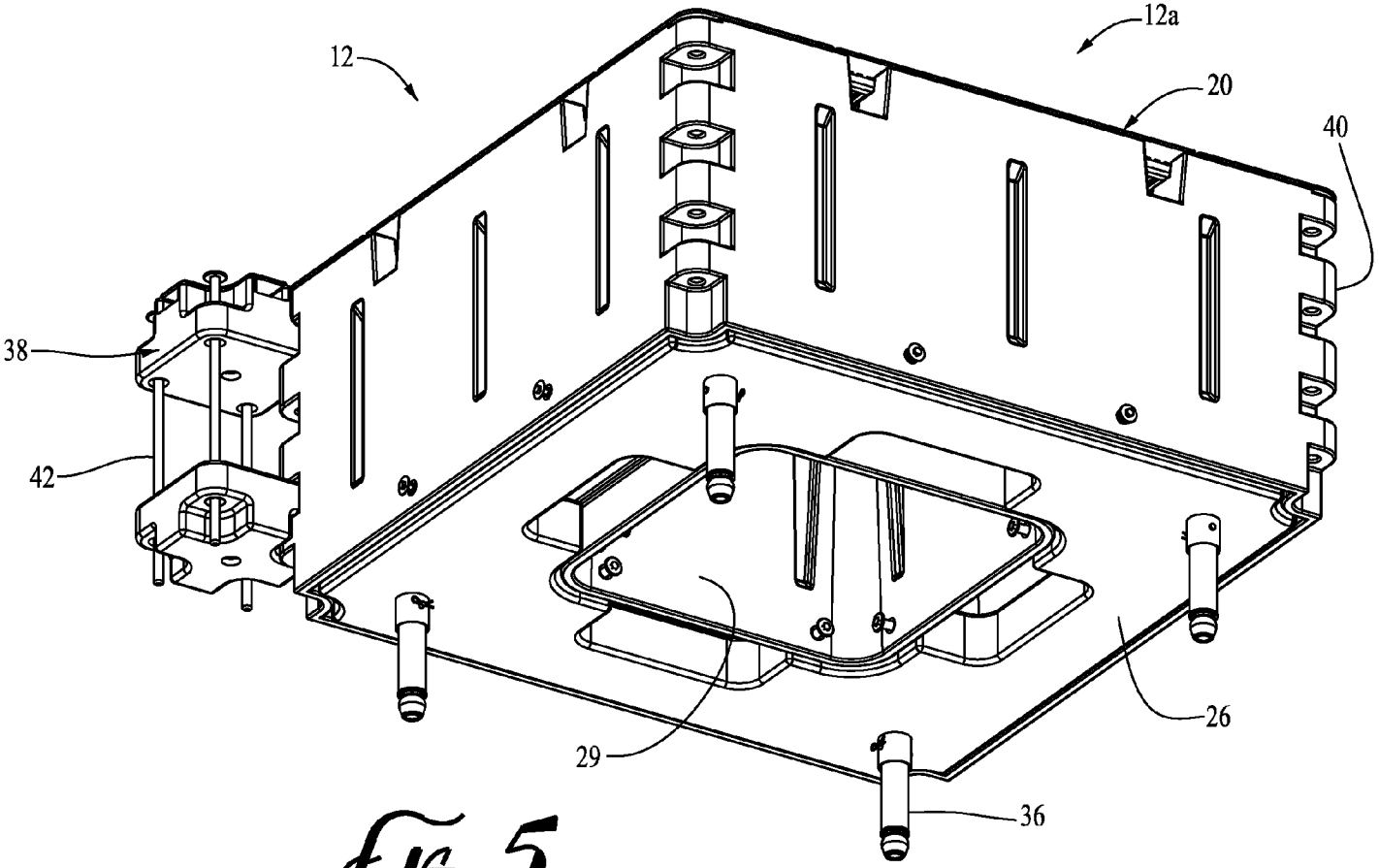
FIG. 5 is a perspective view showing the underside of the module illustrated in FIG. 3.
Figure 6:
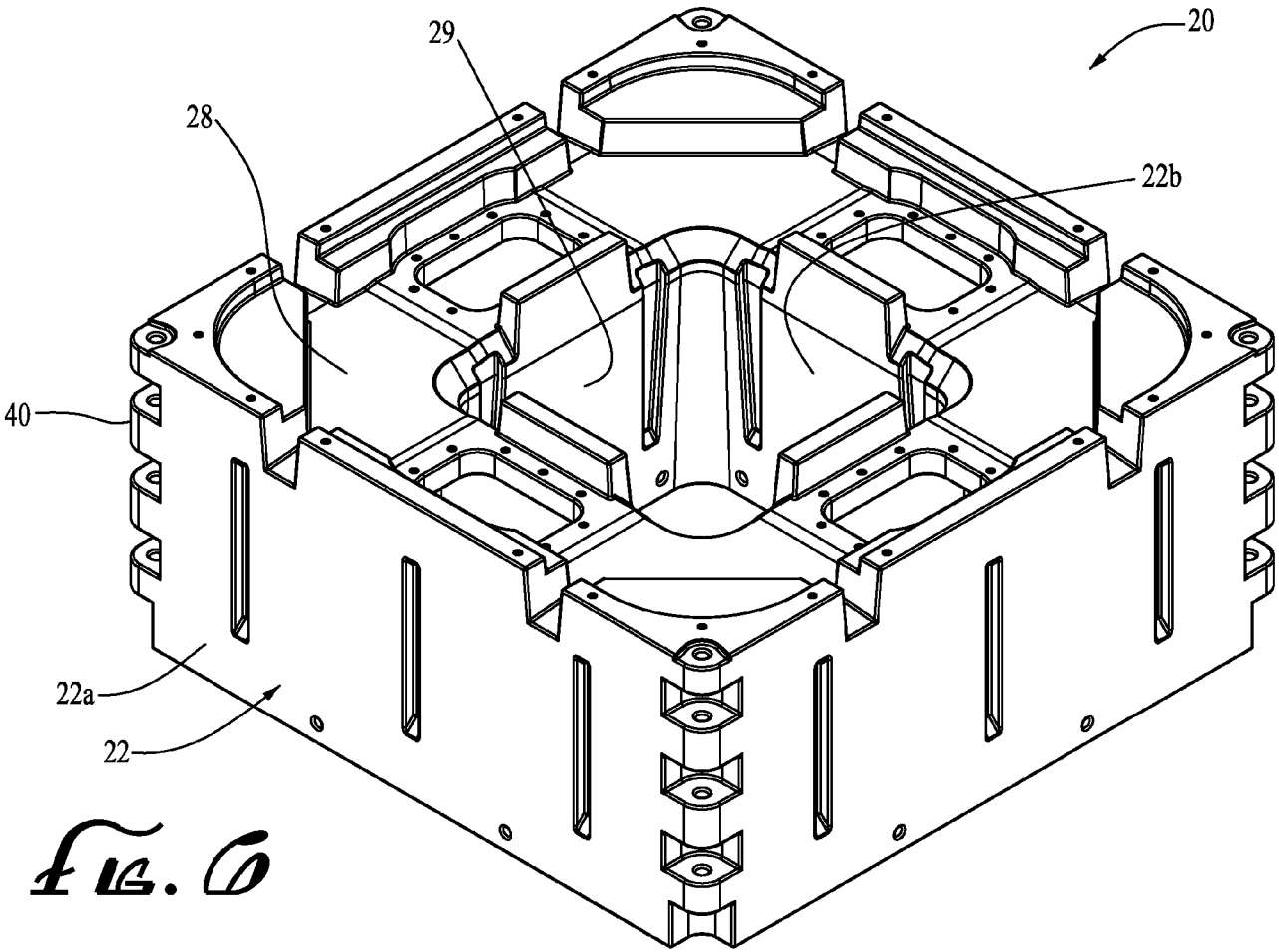
FIG. 6 is a perspective view of the hull of the module illustrated in FIG. 3.

FIG. 1 illustrates one embodiment of the lifting floor 10 disposed on the bottom of an enclosed pool 18. FIG. 2 illustrates the same embodiment raised to near its maximum height within the pool 18.

The plurality of float modules 12 is flexibly connected to one another to yield an integral whole. All module-to-module gaps are typically about standard 6" width, and are preferably filled by grating.

The plurality of float modules 12 typically comprises standard modules 12*a* and edge modules 12*b*. Standard float modules 12*a* are used to cover as much of pool area as possible. FIG. 3-6 illustrate a typical standard float module 12*a*.

Each float module 12 comprises a hull 20 with downwardly extending side walls 22, a top wall 24, a bottom 26 and a buoyancy compartment 28. In a typical embodiment, an outer wall 22*a* and an inner wall 22*b* of the hull side walls 22 together define the buoyancy compartment 28 therebetween.

The bottom 26 of each float module 12 is typically at least partially open and can be made of a concrete to provide proper ballast.

The hull 20 of each standard float module can be a hollow polyethylene rotomolded part. The skin thickness can be about 0.25 inches. The side walls 22 can have a hollow double wall construction, comprising a total thickness 0.375 inches-0.5 inches, and comprising concrete and/or foam fill. Concrete fill allows the final weight to be adjusted for the desired buoyancy. Foam fill assures that the modules 12 will not fill with water and provides additional stiffening. The foam is preferably hydrophobic.

The hull 20 of each module 12 defines a large central opening 29 covered by a grate 30. The grate 30 is typically made of deck grating of an open style fiberglass that allows water to flow through the module 12 during ascent and descent. Access hatches are provided in selected modules 12 to allow diver access to the area below the lifting floor 10 when the lifting floor 10 is raised. The grate 30 is removable for access to buoyancy assemblies 32 disposed within each module 12.

Disposed within each module 12 is a buoyancy assembly 32 comprising a container 14, associated valves and connecting tubing.

Each float module 12 further comprises at least one flood valve 34 to allow water to refill the buoyancy compartment 28. The flood valve 34 can be an air actuated flap mechanism mounted near the top of the buoyancy compartment 28. The flood valve 34 is normally held closed by springs. When actuated, a pneumatic air bag style actuator forces the flaps to an open position allowing the air to be vented from the buoyancy compartment 28, thereby flooding the buoyancy compartment 28 and making the module 12 negatively buoyant for descent. To minimize trapped air when the lifting floor 10 is not level, two flood valves 34 are preferably mounted on opposite ends of standard float module 12.

The underside of each standard float module 12*a* comprises a plurality of support feet 36 which can be made from either a plastic or a metal material. The support feet 36 are dimensioned for leveling the module 12*a* and allowing it to stand evenly a few inches above the floor of the pool 18.

The standard modules 12*a* typically have a square top side area of between about 3 square feet and about 10 square feet. In a typical embodiment, the standard float modules 12*a* are 24-36 inches tall. In one example, the standard float modules 12*a* have approximately 7 square feet of top side area and are 32.5 inches tall.

The lifting floor 10 of the invention can be adapted for use in pools 18 of different depths. In a typical application, the pool depth is between about 15 and about 35 feet. Deeper pool applications can utilize a 36-inch tall float, while shallow pool applications can utilize a 24-inch tall float module 12. 36-inch float modules 12 have a large central opening 29 for increased flow and faster rise speeds to account for the longer travel distance in a deep pool. 24-inch float modules 12 have a smaller central opening 29, since a slower flow rate and rise speed are required at shallower depths.

Each float module 12 is attached to adjacent float modules 12 by means of flexible joints 38. Typically, the flexible joints 38 are disposed at the corners of each module 12 and are each attached to a link retainer 40 formed into the corners of each module 12. Each link retainer 40 is typically made from a polyurethane or other plastic and can be held in place with metal rods 42.

Preferably, the lifting floor 10 is disposed sufficiently proximate to the walls of the pool 18 so as to prevent a human being from falling from the lifting floor 10 between the lifting floor 10 and the walls of the pool 18. It is also important in the invention that the lifting floor 10 be sufficiently close to the pool walls to prevent aquatic mammals from gaining access below the lifting floor 10. Accordingly, the lifting floor 10 is preferably adapted to the shape of the pool 18 where it is employed. In order to accommodate each pool shape, the periphery is fitted with edge float modules 12*b* that are custom shaped to closely fit the plan view of the pool 18.

The edge float modules 12*b* are typically made of metal, but are otherwise comprised of the components of the standard float modules 12*a*. The edge float modules 12*b* have corners which are individually shaped along one or two side edges to allow each of the edge float modules 12*b* to closely match the surface dimensions of the pool 18.

The edge float modules 12*b* preferably comprise bearing surfaces or bumpers capable of contacting the side walls 22 of the pools 18. Alternatively, the edge float modules 12*b* can comprise rollers capable of contacting the walls of the pool 18.

In pools 18 having a bottom with a slanted perimeter, the edge modules 12*b* preferably comprise a sloped bottom 26 capable of contacting the slanted perimeter of the pool bottom when the lifting floor 10 is disposed proximate to the pool bottom. Pads are preferably provided at the bottom of each module 12 whenever the module 12 rests against the pool bottom.

Figure 7:
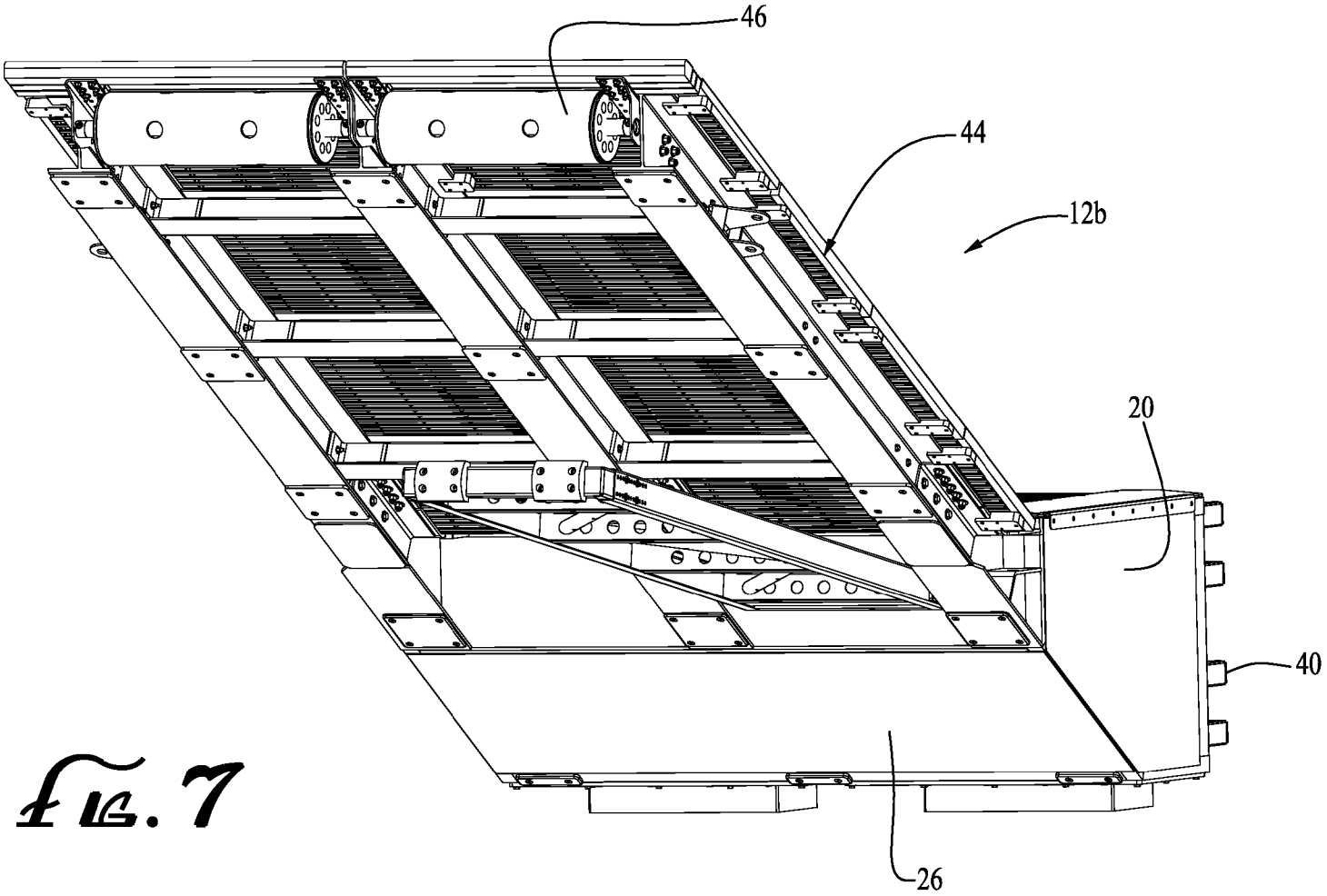
FIG. 7 is a perspective view illustrating an edge module used in the lifting floor illustrated in FIG. 1.

As illustrated in FIG. 7, in pools 18 having a bottom 26 with a slanted perimeter of exceptional width, the edge modules 12*b* preferably comprise an edge wall 44 cantilevered off of the edge module 12*b* at an angle matching the slope of the slanted perimeter. The edge walls 44 are preferably of sufficient length to reach within about 4 inches of the pool walls. Plastic rollers 46 on stainless tube shafts can be affixed to the ends of the edge walls 44 to prevent undue friction between the edge walls 44 and the pool walls.

Figure 8:
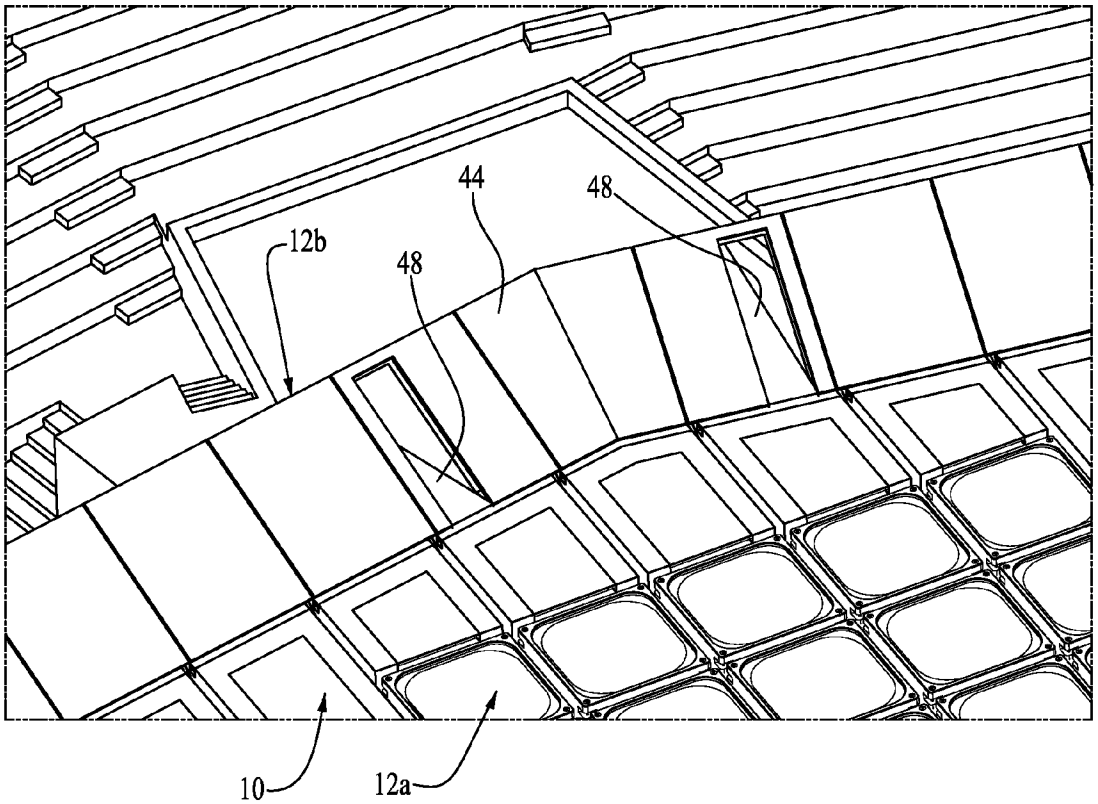
FIG. 8 is a perspective view of a portion of the lifting floor illustrated in FIG. 1, showing a pair of pool edge access doors.

As illustrated in FIG. 8, access gates 48 can be provided in one or more of the edge walls 44 to allow access between the lifting platform 10 and the area surrounding the pool 18.

In pools 18 having corners, the edge modules 12*b* typically comprise one or more corner modules 12*c*, custom shaped to match the shape of the pool corners.

Figure 9:
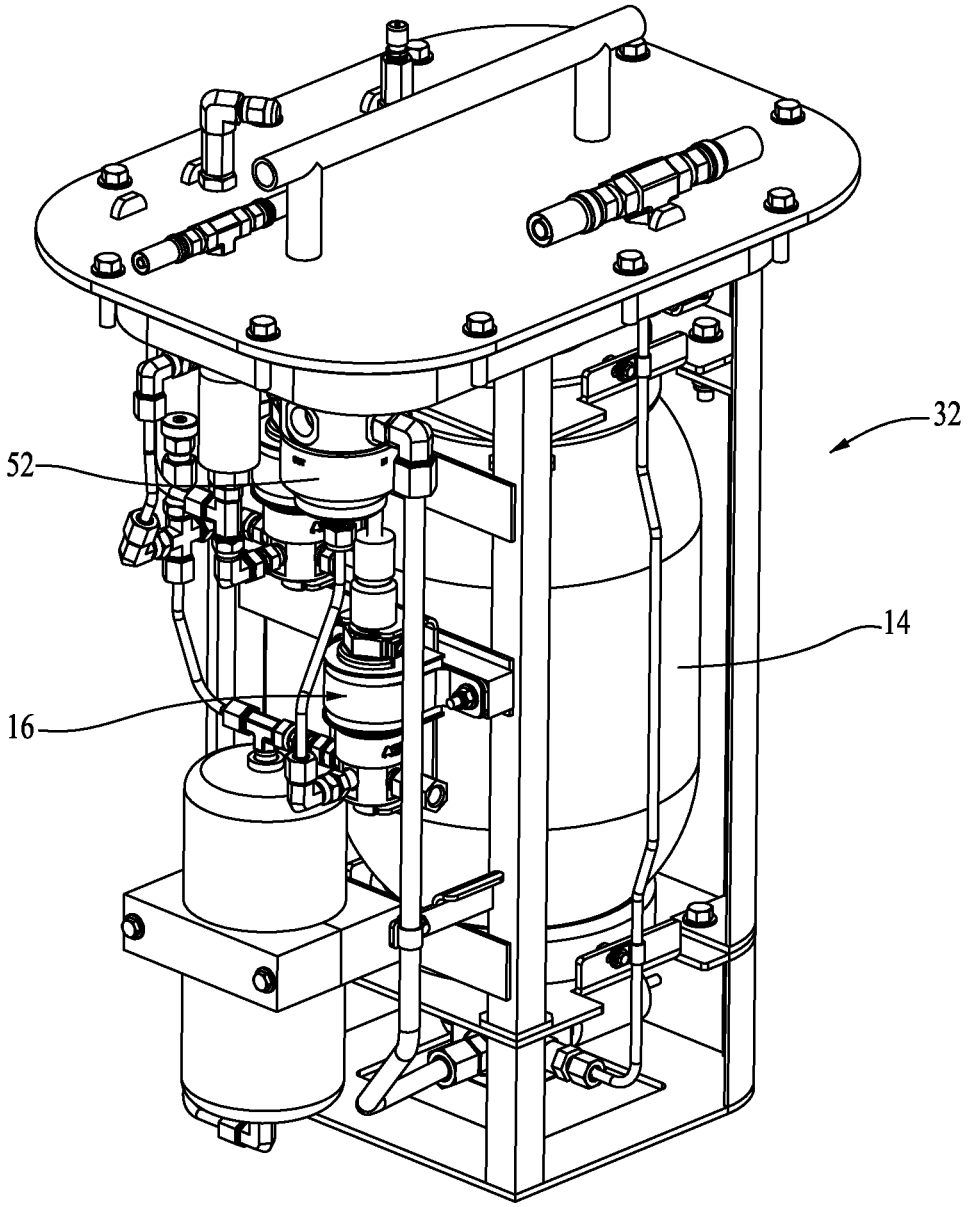
FIG. 9 is a perspective view of a buoyancy assembly used within the module illustrated in FIG. 3.
Figure 10:
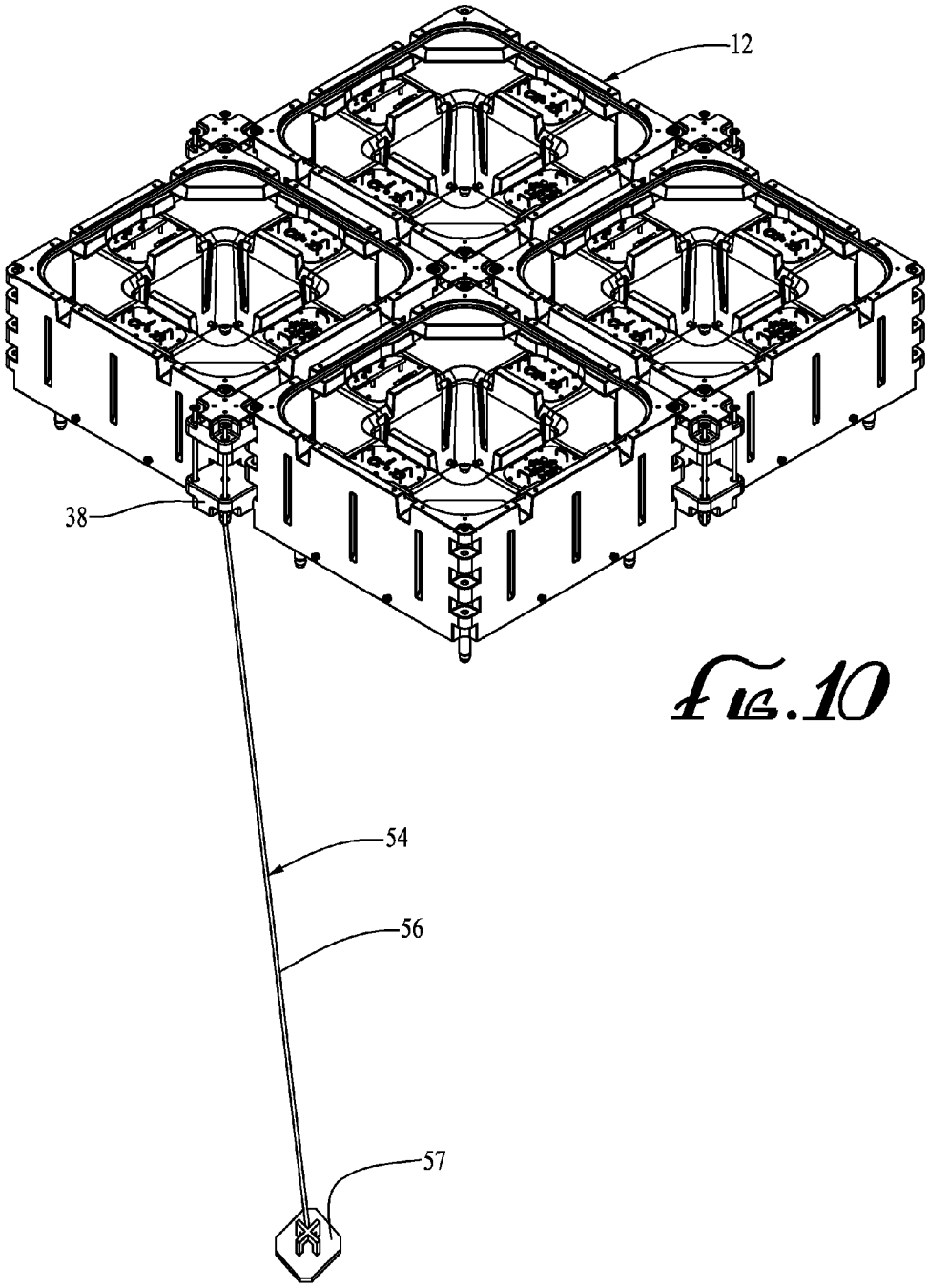
FIG. 10 is a perspective view illustrating a module such as illustrated in FIG. 5 having a tether attached thereto.

As noted above, each container 14 is a component of a buoyancy assembly 32 disposed within each float module 12. FIG. 9 illustrates a typical buoyancy assembly 32.

Also as noted above, each container 14 is capable of retaining an operable supply of low density fluid. In the embodiment illustrated in the drawings, the container 14 is a compressed air tank, capable of retaining an operable supply of compressed air. Each container 14 has a discharge port adapted to discharge buoyancy fluid into the buoyancy compartment 28.

The buoyancy assembly 32 typically further comprises (i) a check valve for allowing the air tank to be pressurized and for preventing air from escaping from the container 14 and (ii) a blow valve 52 attached at each discharge port which is remotely operated to allow air from the container 14 to escape into the buoyancy compartment 28.

Each blow valve 52 is either pneumatically or electrically operated. Thus, the blow valves 52 can be solenoid valves or air actuated poppet valves. A shore based electrical signal can active each solenoid valve. A shore based air discharge activation signal can actuate each poppet valve. The solenoid valve or poppet valve typically comprises the pressure in air tanks at 2500-4000 psi charge level. When actuated, each blow valve 52 opens to fill the buoyancy compartment 28 with air, thereby causing the module 12 to be positively buoyant for ascent.

A discharge apparatus 16 is provided within each buoyancy assembly 32 to open some or all of the blow valves 52, so as to fill each buoyancy compartment 28 with buoyancy fluid, thereby causing the plurality of modules 12 to float to a position at or near the surface of the body of water.

Preferably, the discharge apparatus 16 is capable of opening all of the blow valves 52 simultaneously or within a few seconds of one another, such as within 3-10 seconds of one another. As noted above, it is preferable that the opening of a majority of the blow valves 52 can be actuated from a location disposed distant from the lifting floor 10.

In the embodiment illustrated in the drawings, associated on board electrical and electronic control components are housed in an electrical component pod 53 disposed in each module 12.

Preferably, the discharge apparatus 16 comprises a programmable logic controller continued capable of being programmed to open the blow valves 52 in individual modules 12 at predetermined time intervals to maintain trim stability of the lifting platform 10 during ascent.

In pneumatic systems, the blow valves 52 are preferably actuated by two actuator valves. The two actuator valves are interconnected to provide redundancy. The redundancy gives the discharge opening apparatus 16 the ability to raise the lifting floor 10 in the event of a failure of a single actuator valve.

A high pressure charge air line is typically connected to the manifold to allow the air tanks to be monitored and charged from a shore based air compressor and monitoring system. In this regard, a high pressure recharge air compressor and dryer system can be provided. A high pressure recharge system is also provided, including plumbing or piping as required to transmit high pressure air to the control valve location(s). Pneumatic piping is typically used between the local pool control valve locations. Piping is provided from the control valve locations to the lifting floor 10. Piping is also provided to the control valve locations from a source of air compression, such as an air compressor and high pressure air supply system. The charge air line may or may not be permanently attached. The charge air line also allows make-up air to be pumped into the lifting floor 10 when the lifting floor 10 is raised to overcome any incidental leakage in the float modules 12 and maintain the lifting floor 10 in the raised position indefinitely.

In each module 12, the net lifting force with a fully blown buoyancy compartment 28 is typically 2,500-3,000 lbs.

Local operational control stations are provided to initiate emergency raise, routine raise and routine lower motions. Typically, one to three guarded pushbutton panels per pool 18 are used to initiate the emergency raise motions. The routine raise and lower positions are typically initiated via a separate dedicated push-button panel.

Typically, on shore control valves are located in enclosures. Each enclosure is preferably located as close as possible to the edge of the pool 18.

As noted above, a central programmable logic controller is used to monitor and control the lifting floor 10 throughout the facility. The controller;

- Interfaces with the operator and monitoring stations
- Provides the valve control sequencing for different operating modes
- Provides system status monitoring and error annunciation
- Provides manual control functions for system maintenance and debugging
- Controls and confirms the closing of any gates used to allow access from the pool 18 to an adjoining pool.

The controller can be located in an electrical enclosure along with appropriate power supplies, control relays and distribution equipment.

As noted above, during raising operations, the lifting platform 10 can be controlled by opening the blow valves 52 in a programmed sequence. The inner module blow valves 52 are typically activated first, followed by perimeter module blow valves 52.

To initiate lowering operations, the flood valves 34 are automatically cycled to bring the lifting floor 10 to the bottom of the pool 18. During lowering operations, the lifting floor 10 can be controlled by reacting to lifting floor depth. A command to lower the lifting floor 10 causes the flood valves 34 to activate and the blow valves 52 to pulse to maintain attitude/levelness/trim stability. A control system algorithm used in lower operations is based on a virtual axis. The virtual axis is the target depth versus time. Each control zone is plotted and compared to virtual axis. At specified increments, the control system calculates the difference between actual depth and virtual depth. The blow valve 52 activation time is calculated using the depth difference and a predetermined gain. The gain is a predetermined program variable.

Typically, an audible alarm is adapted to sound whenever the lifting floor 10 is activated. The alarm type and duration can vary depending on if the lifting floor 10 is activated in emergency or routine maintenance mode.

The controller is typically disposed in a monitoring station located in a central, control booth. Remote operator stations can be also be provided for routine operation of an individual lifting floor 10 assembly. Remote operator stations are preferably located within direct line of sight of the pool 18. The remote operator stations are used for routine operation of the lifting floor 10. Additional control stations can be located around the pool 18 to trigger emergency lifting floor deployment.

The lifting floor 10 can further comprise a stabilizer apparatus 54 for stabilizing the plurality of modules 12 during the ascent through the body of water and/or during the time that they are at a position near the surface of the body of water.

In open water applications, the stabilizer apparatus 54 can be employed to prevent the lifting floor 10 from fully rising to the surface. Often, restricting the rise of the lifting floor 10 to within about 6 and 18 inches (for example, approximately 12 inches) of the surface is preferred to minimize the effect of wind and waves on the lifting platform. In one embodiment, tethers 56 and anchor assemblies are used to limit the upward travel of the lifting floor 10. A typical tether 56 and anchor assembly is illustrated in FIG. 9. The upper end of each tether 56 is attached at its upper end to the float modules 12. The lower end of each tether 56 is attached to an anchor 57 at the bottom of the body of water.

Figure 11:
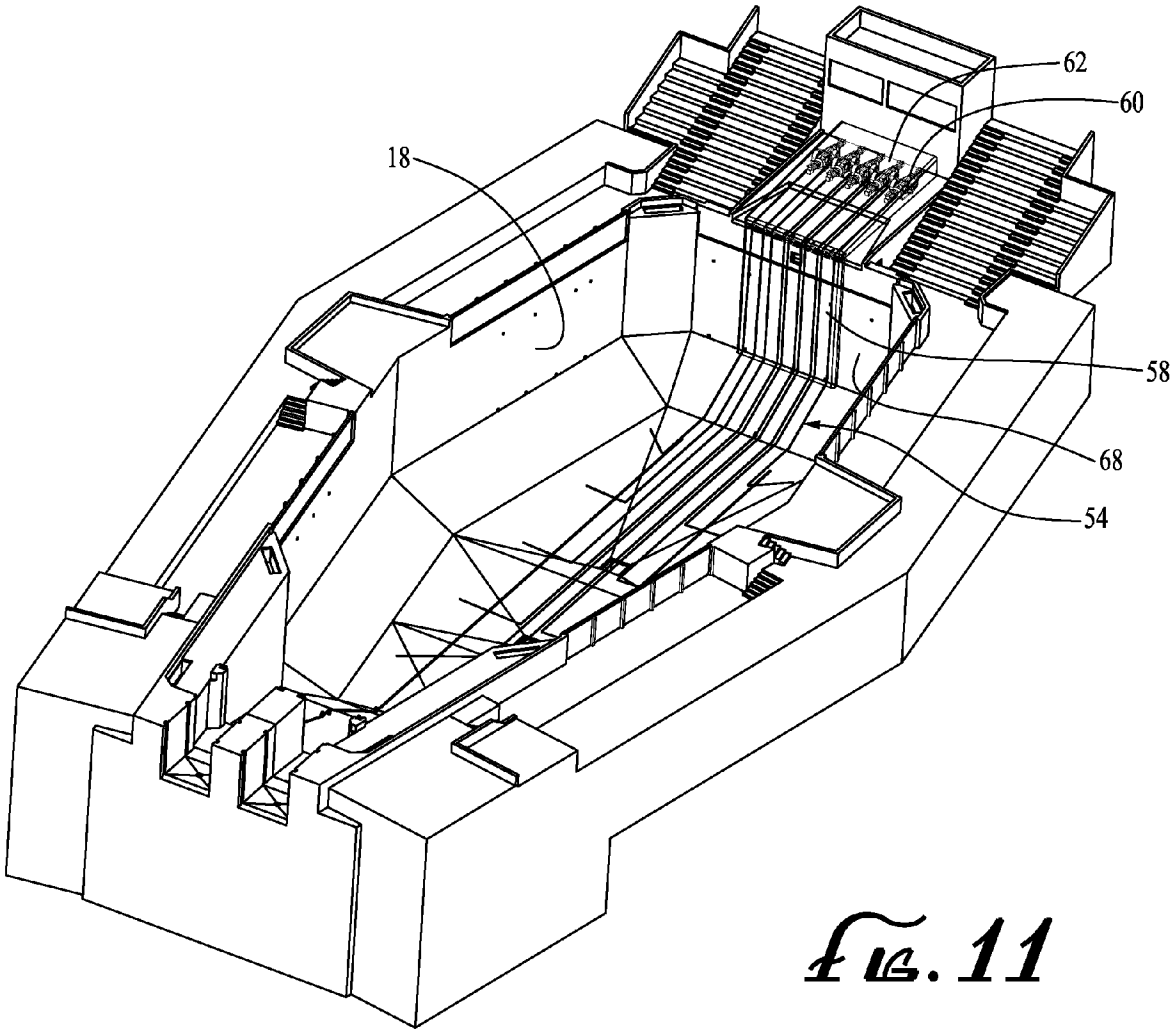
FIG. 11 is a perspective view of an enclosed pool having portions of a stabilizer apparatus disposed therein.
Figure 12:
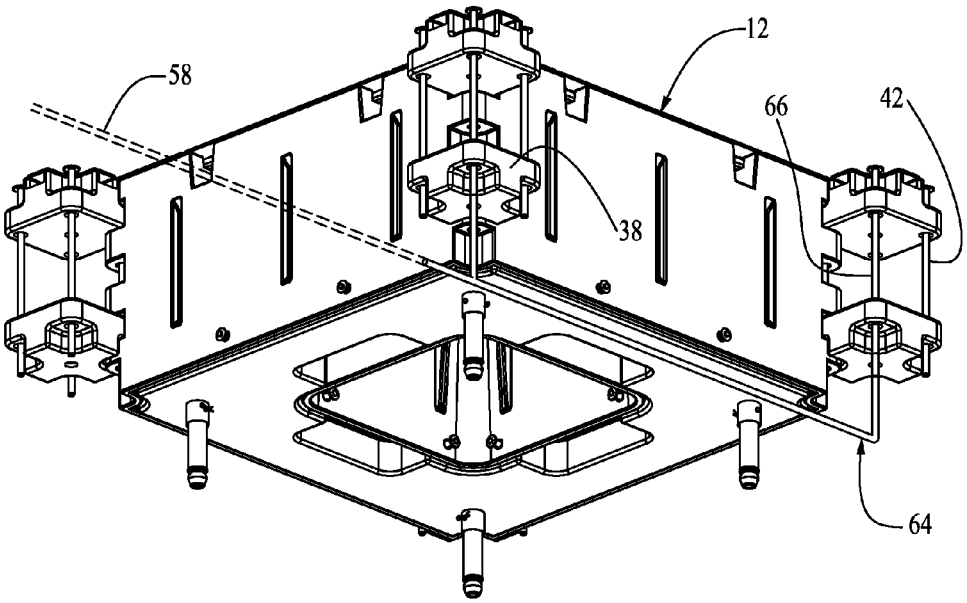
FIG. 12 is a perspective view of the module illustrated in FIG. 3 showing additional portions of stabilizer assembly illustrated in FIG. 11 attached to a module.

As illustrated in FIGS. 11 and 12, in enclosed pool applications, the stabilizer apparatus 54 can comprise cords 58 slidably attached to the bottom of the pool 18 and fixed to one of the modules 12. Each cord 58 is capable of being unwound under tension from the drum of a winch 60 so as to retard portions of the lifting platform 10 during the raising of the lifting platform 10. In such a stabilizer apparatus 54, an external trim control system is used to monitor and control vertical stability of the overall lifting floor 10 during ascent. The purpose of this stabilizer apparatus 54 is to restrain a "runaway" module 12 from rising too quickly, to maintain lateral stability of the entire lifting floor 10 when it is at or near the surface and to maintain lateral position of the lifting floor 10 when it is being lowered to the pool bottom.

In this stabilizer apparatus embodiment, the cords 58 are typically strung within turning sheaves attached to the pool bottom. The sheaves preferably have "keepers" to maintain cords 58 in their grooves if they become slack. Cords 58 feed along the pool bottom and up the side of the pool wall to a winch 60 located pool-side. The cords 58 reel-in and pay-out in unison using a position control system. A host processor checks to see that all the modules 12 are within an allowable elevation window of each other. A typical winch motor is a 20 hp electric VFD gear motor.

The winches 60 are located at a winch location 62 disposed beyond one end of the pool. Edge sheaves are typically used to route the cords 58 from the winch 60 location down the pool wall. Corner sheaves are used to route the cords 58 along chamfers to the bottom of the pool 18. Floor sheaves route the cords 58 along the bottom of the pool to flagging sheaves. Flagging sheaves route each cord 58 to one or more connection points on selected modules 12. Typically, one pair of inter-module connectors 64 located at a module corner is used to anchor each cord connection. The vertical rise of each cord 58 to the pair of inter-module connectors 64 can be shrouded in a connector tube 66, typically a stainless steel tube. A second pair of inter-module connectors 64 can be used to help react bending (for tension at the pool bottom).

The winches 60 are typically enclosed in a housing for visual shielding and for protection of the winches 60 and associated equipment from the elements. The wall of the pool 18 can be shielded from the cords 58 by a shroud 68 disposed along the vertical rise of the pool wall.

In a large enclosed pool 18, wherein the lifting floor 10 has an ascent rate of about 9 feet per second, a typical gross restraint level of the stabilizer apparatus 54 is of the order of 100,000 pounds. For such a restraint level, 8 to 10 cords 58 can be used. Each of the cords 58 can be made of high modulus polyethylene (HMPE). Plasma 12-strand cord having a diameter of one inch can be employed. Such plasma 12-strand cord can be obtained from the Cortland Company of Cortland, N.Y.

An alternative stabilizer apparatus 54 for closed pools 18 can comprise actuators attached to the bottom of the lifting floor 10, the actuators being fluidically energized so as to controllably assist or retard the lifting floor 10 during the raising and lowering of the lifting floor 10.

Another alternative stabilizer for an enclosed pool 18 can comprise an ascent retarding device mounted within at least one float module 12. The retarding device is a tuneable flow-limiting orifice or a winch 60 having a cord 58 with a retractable end attached to the floor of the pool 18.

Preferably, the lifting floor 10 is capable of raising a load of 1000 pounds from a position proximate to the bottom of a body of water having a depth of 25 feet to a position close to the surface of the body of water in less than about 60 seconds.

A typical embodiment directed to the raising of multiple aquatic mammals, such as killer whales, is designed for a total asset weight of 40,000 lbs. 40,000 lbs is the approximate weight of four large aquatic mammals weighing 7,000 lbs. and four large aquatic mammals weighing 3,000 lbs. Typically, the maximum individual asset weight is 12,000 lbs.

Once in the raised position, the lifting floor 10 is stable and allows for the movement of personnel across any area of the lifting floor 10 to deal with any emergency.

After deployment of the raised position, the lifting floor 10 can be lowered to the pool bottom by controlled flooding of the buoyancy compartments 28. Humans and/or aquatic mammals may be present when the lifting floor 10 is lowered.

The lifting floor 10 is preferably equipped with lock-out/tag-out capability to allow for safe service, maintenance and cleaning of the lifting floor 10 and all areas under the lifting floor 10.

Also, all components which may come in contact with aquatic mammals or personnel are preferably free of sharp edges or loose parts.

Preferably, the lifting floor 10 is designed for a long life, such as a 20-year life. Typically, it is designed for one cycle every week, which is the equivalent of 1040 total cycles over a 20-year period. Materials used in the construction of the invention should be suitable for extended service life in the aqueous atmosphere present in the pool—such as in a chlorinated and ozonated artificial saltwater or natural seawater operating environment. Materials are selected to minimize the occurrence of discoloration, oxidation, or corrosion of each component.

The lifting floor 10 can be implemented in a variety of pools 18 at a single location. The lifting floors 10 for all of the pools 18 at a single location can be supported by a centralized system to provide controls for raising and lowering the individual pool lifting floors 10 and a high pressure compressor system to recharge the air tanks mounted in the float modules 12.

Having thus described the invention, it should be apparent that numerous structural modifications and adaptations may be resorted to without departing from the scope and fair meaning of the instant invention as set forth hereinabove and as described herein below by the claims.

What is claimed:

1. A lifting floor for use in a body of water, the lifting floor comprising:

a. a plurality of adjacent float modules, each float module flexibly joined to an adjacent float module, each float module comprising:

i. a hull comprising:

1. a plurality of downwardly extending side walls;
2. a top wall connected to the plurality of downwardly extending side walls;
3. a bottom connected to the plurality of downwardly extending side walls; and
4. a buoyancy compartment disposed within the hull; and ii. container disposed within the float module, the container configured to retain a buoyancy fluid having a density less than that of water; and b. a discharger comprising a controller configured to programmable discharge buoyancy fluid from each container into a buoyancy compartment of a different float module sufficient to to fill the buoyancy compartment of a the different float module with the buoyancy fluid, thereby causing the plurality of float modules to float to a position at or near the surface of the body of water.

2. The lifting floor of claim 1 wherein the discharger is configured to be capable of discharging buoyancy fluid to the buoyancy compartments of all float modules within 0 to 10 seconds of one another.

3. The lifting floor of claim 1 wherein the bottom of each float module is at least partially open.

4. The lifting floor of claim 1 further comprising a stabilizer configured to stabilize the plurality of float modules during their ascent through the body of water and during the time that they are at a position near the surface of the body of water.

5. The lifting floor of claim 4 wherein the stabilizer comprises a tether comprising an upper end attached to one of plurality of the float modules.

6. The lifting floor of claim 1 wherein the controller is configured to programmably discharge buoyancy fluid to the buoyancy compartments in different float modules at predetermined time intervals.

7. The lifting floor of claim 1 wherein:

a. each float module is flexibly joined to an adjacent float module via a flexible joint disposed at a corner of each float module; and b. the flexible joint comprises a plastic disc held in place by a rod.

8. The lifting floor of claim 1 wherein the lifting floor is configured to be capable of raising a load disposed upon the lifting floor weighing greater than about 1000 pounds.

9. The lifting floor of claim 1 wherein the float modules comprise a predetermined set of physical dimensions defining a top view area between about 3 square feet and about 10 square feet.

10. The lifting floor of claim 1 wherein the lifting floor is configured to be capable of raising a load of 1000 pounds from a position proximate to the bottom of a body of water having a depth of 25 feet to a position close to the surface of the body of water in less than about 60 seconds.

11. The lifting floor of claim 1 wherein the discharger is configured to be actuated from a location disposed distant from the lifting floor.

12. A lifting floor for use in an enclosed water-filled pool, the lifting floor comprising:

a. a plurality of float modules, each float module having a hull with downwardly extending side walls, a top wall and a partially opened bottom, the top wall defining a central opening covered with a perforated floor having voids to allow water to flow there through, the underside of the top wall having downwardly extending interior walls spaced apart from the central opening, the interior walls cooperating with the sides walls to define a buoyancy compartment, each float module being attached to adjacent float modules at flexible joints provided by flexible connections;

b. at least one container disposed in each float module for retaining a pressurized gas; and c. a discharge apparatus for discharging buoyancy fluid, from each container so as to fill the buoyancy compartment with buoyancy fluid, thereby causing the plurality of modules to float to a position near the surface of the body of water.

13. The lifting floor of claim 12 wherein the discharge apparatus is capable of discharging buoyancy fluid to the buoyancy compartments of all float modules within 0 to 10 seconds of one another.

14. The lifting floor of claim 12 further comprising a stabilizer apparatus for stabilizing the plurality of modules during their ascent through the body of water and during the time that they are at a position near the surface of the body of water.

15. The lifting floor of claim 14 wherein the lifting floor comprises a top side and a bottom side, and wherein the stabilizer apparatus comprises cords slidably attached to the bottom of the pool and fixed to one of the modules, the cords being capable of being unwound under tension from winch drums so as to retard portions of the lifting platform during the raising of the lifting platform.

16. The lifting floor of claim 12 wherein the discharge apparatus can be actuated from a location disposed distant from the lifting floor.

17. The lifting floor of claim 12 wherein the discharge apparatus is capable of being programmed to discharge buoyancy fluid to the buoyancy compartments in different modules at predetermined time intervals.

18. The lifting floor of claim 12 wherein the flexible joints are disposed at the corners of each module and comprise plastic discs held in place by metal plates and rotatable on rods.

19. The lifting floor of claim 12 wherein the lifting floor is capable of raising a load of 1000 pounds from a position proximate to the bottom of a body of water having a depth of 25 feet to a position close to the surface of the body of water in less than about 60 seconds.

20. The lifting floor of claim 12 wherein:

a. the modules comprise modules a predetermined set of physical dimensions defining a top view area of between about 3 square feet and about 10 square feet; and b. edge modules.

21. The lifting floor of claim 12 wherein the lifting floor is disposed sufficiently proximate to the walls of the pool so as to prevent a human being from falling from the lifting floor 10 between the lifting floor and the walls of the pool.

22. The lifting floor of claim 20 wherein the edge modules comprise rollers capable of contacting the walls of the pool during the raising and lowering of the lifting floor.

23. The lifting floor of claim 20 wherein the edge modules comprise bearing surfaces or bumpers capable of contacting the side walls of the pool.

24. The lifting floor of claim 20 wherein the pool comprises a bottom having a slanted perimeter and wherein the edge modules comprise a sloped edge wall capable of contacting the slanted perimeter of the pool bottom when the lifting floor is disposed proximate to the pool bottom.

25. The lifting floor of claim 24 wherein one or more of the edge walls comprise an access gate for providing access to and from the lifting floor.

26. The lifting floor of claim 1, wherein the plurality of downwardly extending side walls comprise an outer wall and an inner wall defining buoyancy compartment disposed within the hull therebetween.

27. The lifting floor of claim 1, wherein the bottom of the float module comprises:

a. a partially open surface; and b. concrete.

28. The lifting floor of claim 1, wherein the hull comprises a hollow polyethylene rotomolded portion.

29. The lifting floor of claim 1, wherein the hull comprises a skin thickness of about 0.25 inches.

30. The lifting floor of claim 1, wherein the side walls comprise a hollow double wall construction, comprising a total thickness of between around 0.375 inches to around 0.5 inches, and comprising a fill material.

31. The lifting floor of claim 30, wherein fill material comprises concrete.

32. The lifting floor of claim 30, wherein the fill material comprises foam fill.

33. The lifting floor of claim 30, wherein the foam fill comprises a hydrophobic foam fill.

34. A lifting floor for use in a body of water, the lifting floor comprising:

a. a plurality of adjacent float modules, each float module flexibly joined to an adjacent float module, each float module comprising:

i. a hull comprising:

1. a plurality of downwardly extending side walls;
2. a top wall connected to the plurality of downwardly extending side walls;
3. a bottom connected to the plurality of downwardly extending side walls; and
4. a buoyancy compartment disposed within the hull; and ii. a container disposed within the float module, the container configured to retain a buoyancy fluid having a density less than that of water;

b. a programmable discharger configured to programmably discharge buoyancy fluid from the container into a buoyancy compartment of a different float module sufficient to fill the buoyancy compartment of the different float module with the buoyancy fluid and cause the plurality of float modules to float to a position at or near the surface of the body of water; and c. a stabilizer configured to stabilize the plurality of float modules during their ascent through the body of water and during the time that they are at a position near the surface of the body of water, the stabilizer comprising a tether, the tether comprising an upper end attached to one of plurality of the float modules.

* * * * *